United States Patent [19]

Robbins

[11] 3,985,092

[45] *Oct. 12, 1976

[54] SAILBOAT TRAVELER APPARATUS

[75] Inventor: Samuel Robbins, Santurce, P.R.

[73] Assignee: Mark L. Robbins, Fullerton, Calif.

[ * ] Notice: The portion of the term of this patent subsequent to Apr. 8, 1992, has been disclaimed.

[22] Filed: Mar. 28, 1975

[21] Appl. No.: 563,290

Related U.S. Application Data

[63] Continuation of Ser. No. 460,267, April 11, 1974, Pat. No. 3,875,889.

[52] U.S. Cl. ..... 114/204; 114/39

[51] Int. Cl.[2] ..... B63H 9/10

[58] Field of Search ..... 114/39, 61, 101, 102, 114/108, 111–115, 204, 218

[56] References Cited

UNITED STATES PATENTS

| | | | |
|---|---|---|---|
| 3,623,445 | 11/1971 | Holmes | 114/204 |
| 3,678,876 | 7/1972 | Alter | 114/218 |
| 3,875,889 | 4/1975 | Robbins | 114/204 |

*Primary Examiner*—Trygve M. Blix
*Assistant Examiner*—Jesus D. Sotelo
*Attorney, Agent, or Firm*—Beveridge, DeGrandi, Kline & Lunsford

[57] ABSTRACT

A traveler assembly used to position a boat sail includes a slider supported in a track mounted on a rigid frame of the boat. The slider consists of a base mounted in the channel-shaped track and hingedly supporting a fairlead assembly including a block, a pair of fairlead sheaves, and an eye-strap for attaching the main sail block. A pivoted cleating assembly is supported on the fairlead block for releasably cleating the single control line.

3 Claims, 5 Drawing Figures

FIG. 3
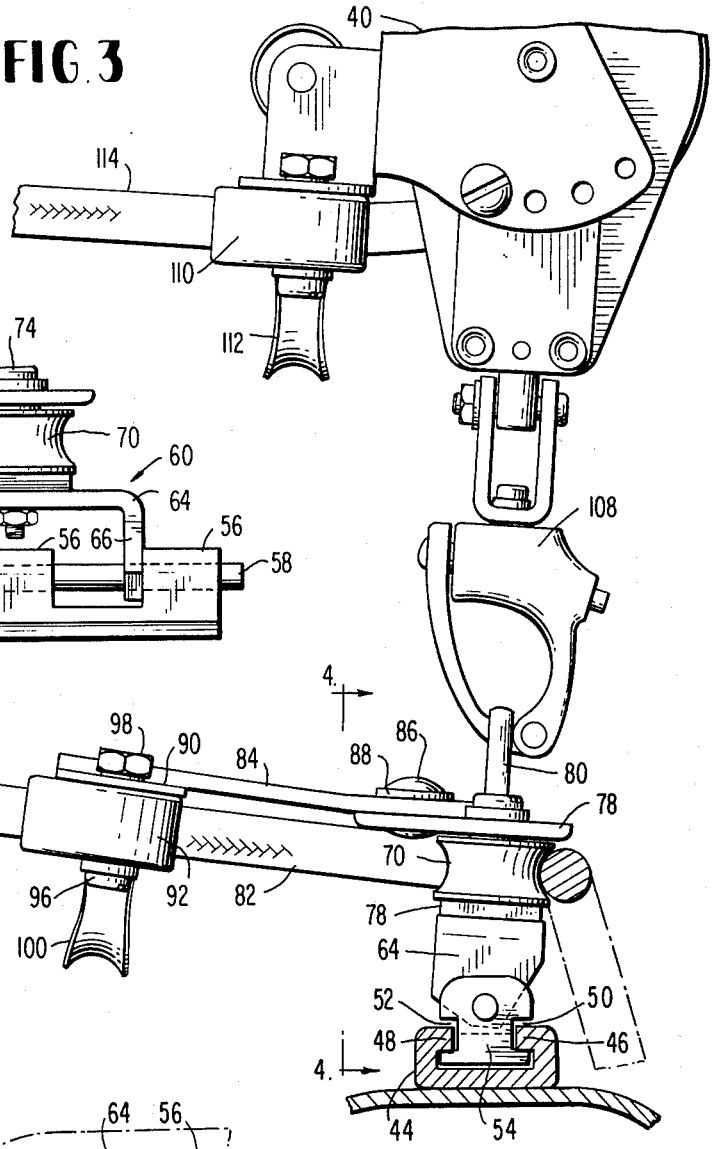
FIG. 4
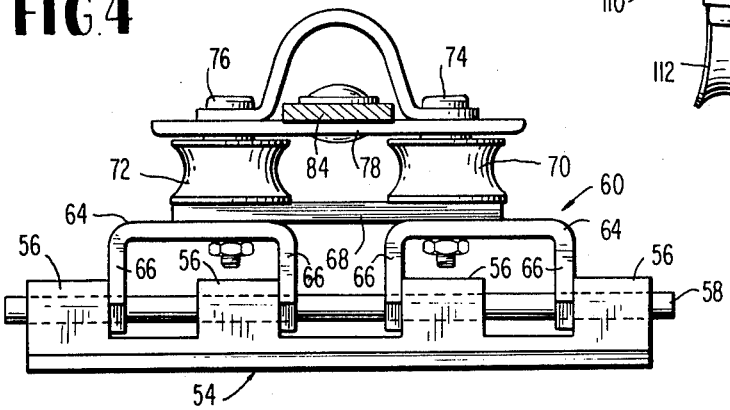
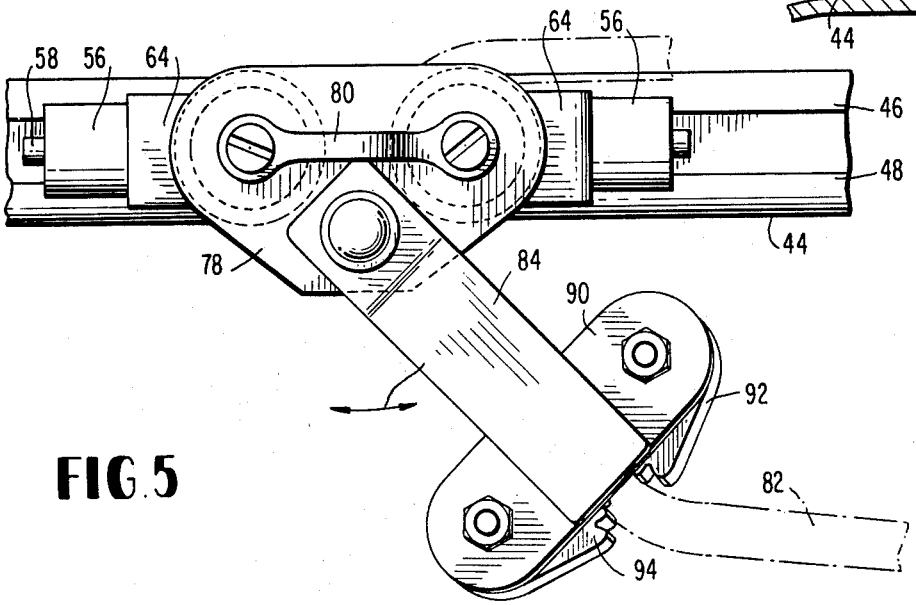
FIG. 5

SAILBOAT TRAVELER APPARATUS

This is a continuation of application Ser. No. 460,267, filed Apr. 11, 1974, now U.S. Pat. No. 3,875,889.

BACKGROUND OF THE INVENTION

Field of the Invention

This invention relates to traveler assemblies, or slider assemblies, employed to position and control a sail on a boat and more particularly to an improved traveler assembly especially well adapted for positioning the main sail of a Hobie catamaran or similar boat.

Description of the Prior Art

Traveler assemblies or sliders for use in positioning and controlling sails on a boat are well-known and numberous structures have been devised for this purpose over the years. The more common of the prior art traveler devices, particularly in recent years, have employed some form of rolling contact between the fixed track or rail and the movable slider block, examples of such devices being disclosed in U.S. Pat. Nos. 3,326,170 and 3,623,445. While these roller or bearing mounted travelers provide the least resistance to movement and therefore the greated ease of control of the sail, they are relatively complex and require substantial attention and maintenance. Further, such bearing mounted travelers are not employed on some classes of boats, and their use is specifically prohibited in certain competitions involving specific classes of boats. For example, Coast Catamaran Corporation, which manufactures the 14 foot and 16 foot Hobie catamarans, specifically excludes use of roller-type traveler cars on their craft, and the Hobie Cat class association specifically prohibits from any local or nationally sponsored Hobie catamaran races the use of any type of bearing or roller-type traveler, which in any way, modifies the standard Hobie traveler track, or which places roller bearings or wheels in surface-to-surface contact with the standard Hobie traveler track.

The standard Hobie traveler track consists of an open-topped channel which is generally in the form of a rectangular tubular member with an elongated slot extending through the top surface of the channel to receive a slider member. The standard slider is in the form of an inverted T-shaped extrusion, with the leg of the T projecting upwardly through the slot in the channel and with the laterally extending arms of the T sliding in the generally rectangular open center of the track in underlying relation with the top wall of the track adjacent the open slot. The track is mounted on the aft transverse beam of the trampoline frame and extends between the two laterally spaced hulls of the boat. Thus, to swing the main sheet about the mainmast, which is mounted on the forward transverse trampoline frame on the fore-and-aft centerline of the boat, the boat's skipper moves the traveler in a straight line along the transverse track. Since the main sheet boom swings in an arc about the mainmast, there is a definite tendency for the force exerted by the line connecting the sail to the traveler to tilt the slider block in the track, thereby causing it to bind or jam in the track, with this tendency normally increasing with the distance of the slider from the leeward side of the boat to the centerline. While self-lubricating plastic bearing blocks, in combination with the anodized aluminum surface on the traveler track, are used to reduce the binding tendency, it nevertheless continues to be a serious problem, particularly in competition where easy and accurate control of the sails is a necessity.

In order to overcome the defects of the standard Hobie traveler assembly, numerous traveler devices have been devised. For example, it has been proposed to provide a hinge in the slider block, near the track, to permit the body of the slider to align itself with the line connecting the sail and slider block while minimizing the turning moment applied to the track-engaging portion of the slider block. It has also been proposed to employ fairlead sheaves on the slider block to reduce the frictional contact with the control line as opposed to merely passing the control line through an aperture in the slider block as in the standard Hobie slider. While these modifications have provided easier and more positive control of the Hobie mainsail, they nevertheless have not proved entirely satisfactory for various reasons. For example, in the prior art hinged traveler, the control line cleating arrangement was mounted on the boat's centerline, and no provisions were made for reducing the friction of the control line passing through the slider assembly. On the other hand, in the prior art devices we have employed fairlead sheaves for the control line, no provision has been made or considered practical for reducing the tendency of the substantial force exerted by the main fiddle block tending to tilt and thereby bind the slider block in the track. None of these have adequately provided for quick and easy cleating and releasing of the control line.

SUMMARY OF THE INVENTION

In view of the above, the primary object of the present invention is to provide a sliding traveler assembly, particularly useful on Hobie Catamaran type boats, which avoids the defects of the prior art sliders by providing maximum ease of operation and positive control of the main sheet.

Another object of the invention is to provide such a traveler which is both simple and inexpensive to manufacture and easy to maintain in service.

In the attainment of the foregoing and other objects, an important feature of the invention resides in providing a slider block molded from a self-lubricating polymeric material and adapted to fit within and slide longitudinally along the standard Hobie anodized aluminum track. The slider body has cut-out portions formed along its length, and a pivot pin extends longitudinally therethrough for pivotally supporting a fairlead and locking assembly including a pair of fairlead sheaves supported for rotation about parallel, generally vertical axis, an eye-structure for connecting to the main fiddle block and a cleating device for automatically cleating the slider control line. A connecting plate joining the tops of the fairlead sheaves cooperates to retain the control line between the sheaves and provides a mounting support for a pivoted arm which extends toward the trampoline and provides support for a set of cam cleats. An eye strap fairlead extends in an arc downwardly below and between the cam cleats to contain the control line thereby permitting it to be quickly released when desired, with the position of the cam cleats being such that the control line is automatically drawn therebetween when a force is applied thereto by the boat's skipper, thereby eliminating any maneuvering on the part of the sailor to cleat the control line when the main sail is positioned.

BRIEF DESCRIPTION OF THE DRAWINGS

The foregoing and other objects and advantages of the invention will become apparent from the following detailed description, taken in conjunction with the drawings, in which:

FIG. 3 is an elevation view of the structure shown in FIG. 2;

FIG. 4 is a sectional view taken on line 4—4 of FIG. 3; and

FIG. 5 is a top plan view of the structure shown in FIG. 2.

DESCRIPTION OF THE PREFERRED EMBODIMENT

Figure 1:
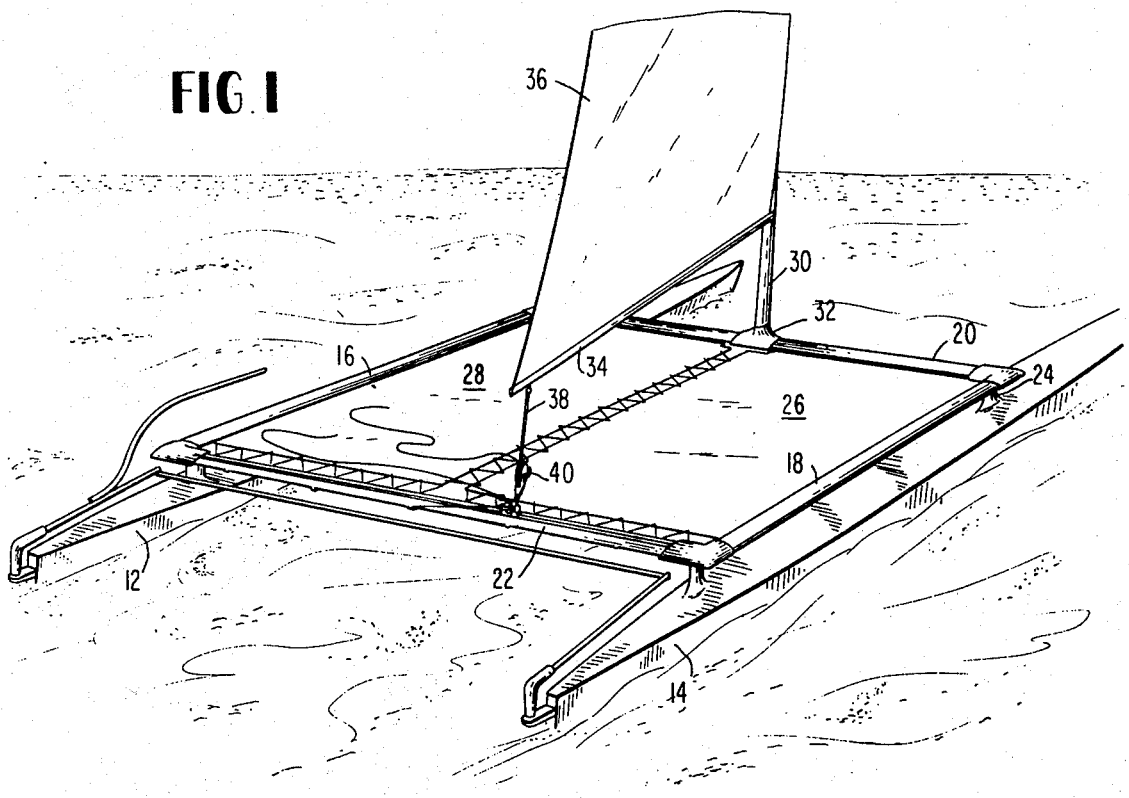
FIG. 1 is a fragmentary perspective view of a Hobie catamaran-type boat of the type with which the present invention is intended to be used.

Referring now to the drawings in detail, a multihull sailboat such as the well-known Hobie catamaran includes port and starboard hulls 12, 14, respectively, rigidly joined by a rectangular trampoline frame including longitudinally extending port and starboard beams 16, 18 and transversely extending forward and aft beams 20, 22. The trampoline frame is supported on the hulls 12, 14 by upwardly extending rigid stanchion members 24. Two sheets of canvas 26, 28 are lashed together and to the trampoline frame under substantial tensile load to define the deck of the boat. The boat's mainmast 30 is supported by a suitable flange structure 32 on the forward beam 20 along the longitudinal centerline of the boat.

The boom 34 for the main sail 36 is pivotally supported on the mast 30 at a point spaced above the bottom thereof in the conventional manner, with the boom 34 extending generally aft and free to swing over the trampoline surface except as restrained by the mainsheet 38 and blocks 40 joining the aft end of the boom 34 to the traveler assembly indicated generally by the reference numberal 42. This portion of the boat 10 is conventional of all Hobie catamarans, reference to which may be had for further structural details.

Referring now to FIGS. 2 – 5, it is seen that the traveler assembly 42 is supported on the aft beam 22 by an elongated, generally rectangular, hollow channel track 44 mounted directly onto the top surface of the beam 22. The track 44 has a top wall in the form of two opposed, inwardly directed flanges 46, 48 adapted to be received in complimentary longitudinal slots 50, 52 in a slider block member 54, with the flanges and slots cooperating to provide a tongue-and-groove interlock preventing the slider 54 from being withdrawn while permitting free longitudinal sliding movement of the body along the track 44. Preferably, the slider block 54 is integrally molded from a single homogeneous mass of a dimensionally stable, rigid, self-lubricating polymeric material to provide minimum sliding friction with the smooth surface of the anodized aluminum track 44.

Figure 2:
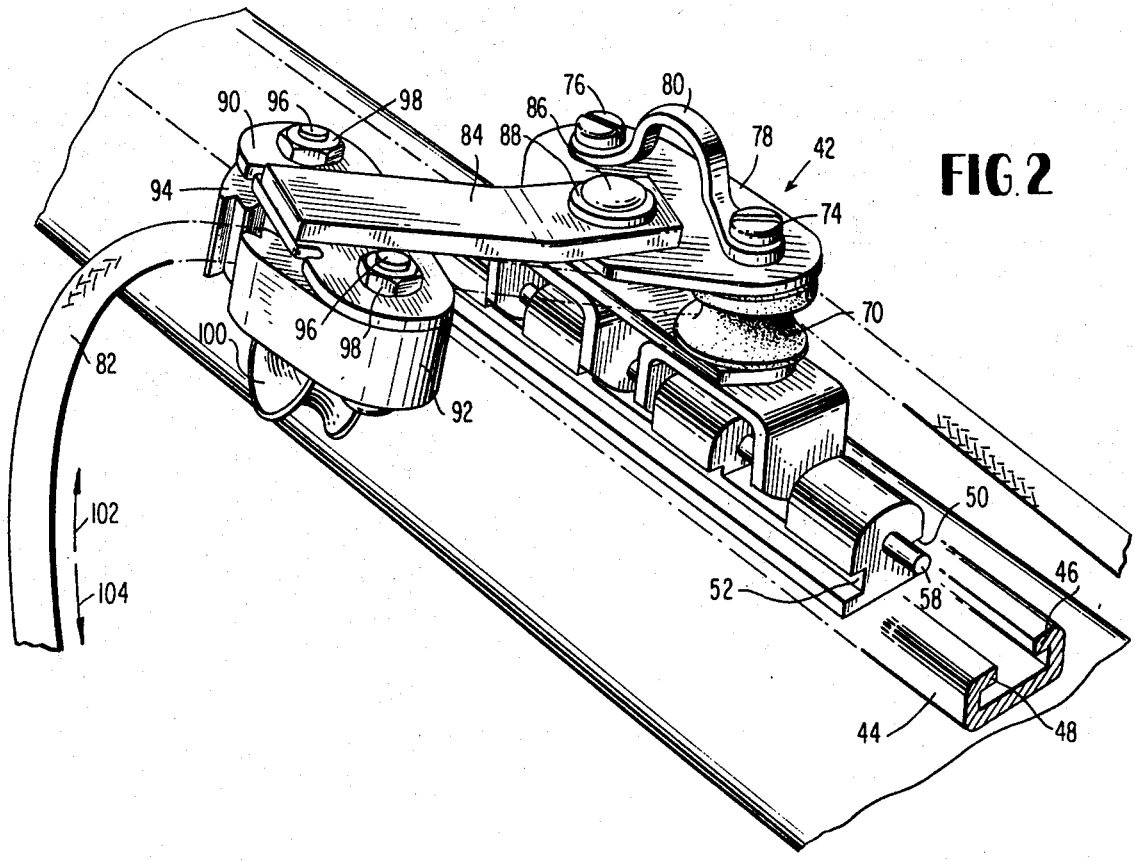
FIG. 2 is an enlarged fragmentary perspective view of the traveler assembly according to the present invention.

As best seen in FIGS. 2 and 4, the slider block 54 has three relatively long notches or recesses formed therein, dividing the top portion into four similar segments indicated generally by the reference numeral 56. A bore extends longitudinally through the respective portions 56 and a stainless steel hinge pin 58 is mounted therein for pivotally supporting a hinged fairlead assembly 60.

The fairlead assembly 60 comprises a pair of support members 64 formed from a length of flat stainless steel bar stock and shaped into the configuration of an inverted "U". The downwardly depending legs 66 of the members 64 are provided with apertures which are received on and pivotally supported by the stainless steel pin 58. A beam member 68 extends between and is clamped to the suport member 64 by screw shafts and a pair of fairlead sheaves 70, 72 are rotatably mounted, as by said screw shafts 74, 76 passed through the beam 68 and bolted to the underside of the underlying support members 64. A plate member 78 and a connecting eye strap 80 are mounted on the upper ends of the screw shafts 74, 76 and overlie the upper ends of the sheaves 70, 72 with the plate 78 and beam 68 cooperating with the opposed arcuate surfaces of the sheaves 70, 72 to define a closed eyelet through which the control line 82 passes so that there is no danger of the line jumping out of one of the fairlead sheaves and causing loss of control of the sail.

An elongated arm 84 is pivotally supported, as by a rivet 86 and washer 88, on the top surface of the plate 78 and extends generally forward in cantilevered relation therefrom. The arm 84 has rigidly mounted, as by spot welding, on the undersurface of its distal end, a cleat mounting plate 90. The plate 90 extends laterally from each side of the arm 84, and a set of cam cleats 92, 94 are mounted one on each end of the plate 90 as by mounting bolts 96 and nuts 98. An eye strap fairlead 100 is supported on the lower end of the bolts 96 and extends in a downwardly curved path between the two cam cleats to permit the control line 82 to be pulled downwardly out of the nip of the cam cleats for movement back through the apparatus in the direction of arrow 102. However, the strap 100 and the cleats 92, 94 form, in effect, an eyelet which retains the line in position to be drawn bank into the nip of the cleats by slight upward movement of the line by the boat skipper, while the plate 90 prevents the control line from being pulled upwardly out of the nip of the cleats.

The cam cleats 92, 94 are level with the fairlead sheaves throughout the full range of hinge or pivotal movement of the fairlead assembly 60 during operation of the boat so that the cleats are substantially in the direct line of pull when control line 82 is being heaved upon to move the main sail in the direction of the boat's centerline, or the close hauled position. Thus, when the main sail is in the desired position, the skipper merely relaxes the pull on the control line 82 permitting it to move slightly in the direction of arrow 104 in FIG. 2. and the cleats automatically releasably secure the line in their nip without the necessity of the skipper moving the line out of its normal line of pull to engage the cleats.

Referring now to FIG. 3, it is seen that the lowermost block 40 of the usual pair of blocks employed to secure the boom 34 to the traveler is secured to the strap 80 by a swivel shackle assembly 108. A set of cam cleats 110, with a downwardly directed eye strap fairlead 112, are mounted on the block 40 for control and cleating of the main sheet 114. This arrangement permits the skipper to readily manipulate lines 82 and 114 simultaneously, one with each hand, whenever necessary and with a minimum of effort.

While I have disclosed and described a preferred embodiment of my invention, I wish it understood that I do not intend to be restricted solely thereto, but rather that I do intend to include all embodiments which would be apparent to one skilled in the art which come within the spirit and scope of my invention.

What is claimed is:

1. A traveler assembly for positioning and controlling a sail on a sailboat and adapted to be slidably mounted on an elongated generally rectangular open-topped track having a pair of inwardly directed flanges formed one along each top edge thereof with the flanges being spaced from one another to define an open slot extending the length of the track, said traveler comprising, in combination, an elongated slider block having a generally rectangular base portion adapted to be slidably received in the hollow interior of said track and extending laterally beneath said flanges and an upwardly projecting portion adapted to extend through the open slot between said flanges, a fairlead assembly including a frame, hinge means pivotally supporting said frame on said upwardly projecting portion of said slider block for limited pivotal movement about an axis parallel to and spaced closely adjacent the track, a pair of fairlead sheaves mounted on said frame for rotation about generally parallel upwardly extending axes, and guide means for retaining a control line between said fairlead sheaves.

2. The traveler assembly as defined in claim 1 wherein said slider block has a pair of grooves formed therein one on each of its opposed side walls in position to receive said inwardly directed flanges on said track in sliding tongue-and-groove relation.

3. The traveler assembly as defined in claim 2 wherein said slider block is integrally molded from a single homogeneous mass of self-lubricating polymeric material.

* * * * *